US006764559B2

(12) United States Patent
Li et al.

(10) Patent No.: US 6,764,559 B2
(45) Date of Patent: Jul. 20, 2004

(54) ALUMINUM AUTOMOTIVE FRAME MEMBERS

(75) Inventors: Zhong Li, Lexington, KY (US); Paul Platek, Massillon, OH (US)

(73) Assignee: Commonwealth Industries, Inc., Urichsville, OH (US)

( * ) Notice: Subject to any disclaimer, the term of this patent is extended or adjusted under 35 U.S.C. 154(b) by 19 days.

(21) Appl. No.: 10/294,877

(22) Filed: Nov. 15, 2002

(65) Prior Publication Data

US 2004/0094245 A1 May 20, 2004

(51) Int. Cl.[7] ..... C22F 1/047

(52) U.S. Cl. ..... 148/523; 148/692; 148/693; 29/421.1

(58) Field of Search ..... 148/523, 692, 148/693; 29/421.1

(56) References Cited

U.S. PATENT DOCUMENTS

| | | | | |
|---|---|---|---|---|
| 3,864,873 | A | 2/1975 | Petry | 73/295 |
| 3,921,697 | A | 11/1975 | Petry | 164/4 |
| 4,567,743 | A | 2/1986 | Cudini | 72/61 |
| 4,648,438 | A | 3/1987 | Hazelett et al. | 164/475 |
| 4,829,803 | A | 5/1989 | Cudini | 72/367 |
| 4,897,124 | A | 1/1990 | Matsuo et al. | 148/2 |
| 4,940,076 | A | 7/1990 | Desautels et al. | 164/452 |
| 4,972,900 | A | 11/1990 | Szczypiorski | 164/481 |
| 5,244,516 | A | 9/1993 | Kawaguchi | 148/551 |
| 5,452,827 | A | 9/1995 | Eckert | 222/594 |
| 5,514,228 | A | 5/1996 | Wyatt-Mair et al. | 148/551 |
| 5,571,347 | A | 11/1996 | Bergsma | 148/550 |
| 5,582,660 | A | 12/1996 | Erickson et al. | 148/688 |
| 5,616,189 | A | 4/1997 | Jin et al. | 148/549 |
| 5,634,991 | A | 6/1997 | Kamat | 148/551 |
| 5,833,775 | A | 11/1998 | Newton et al. | 148/551 |
| 5,913,989 | A | 6/1999 | Wycliffe et al. | 148/437 |
| 5,976,279 | A | 11/1999 | Selepack et al. | 148/551 |
| 5,985,058 | A | 11/1999 | Selepack et al. | 148/551 |
| 5,993,573 | A | 11/1999 | Selepack et al. | 148/551 |
| 6,086,690 | A | 7/2000 | Wycliffe et al. | 148/552 |
| 6,257,035 | B1 | 7/2001 | Marks et al. | 72/57 |
| 6,264,765 | B1 | 7/2001 | Bryant et al. | 148/511 |
| 6,280,543 | B1 | 8/2001 | Zonker et al. | 148/551 |
| 6,322,645 | B1 | 11/2001 | Dykstra et al. | 148/520 |
| 2002/0162877 | A1 * | 11/2002 | Dziadosz et al. | 228/117 |
| 2003/0164207 | A1 * | 9/2003 | Kashiwazaki et al. | 148/440 |
| 2003/0192160 | A1 * | 10/2003 | Luo et al. | 29/421.1 |

* cited by examiner

*Primary Examiner*—George Wyszomierski
(74) *Attorney, Agent, or Firm*—Andrew Alexander

(57) ABSTRACT

Disclosed is a method for producing aluminum vehicular frame members such as frame members from molten aluminum alloy using a continuous caster to cast the alloy into a slab. The method comprises providing a molten aluminum alloy consisting essentially of 2.7 to 3.6 wt. % Mg, 0.1 to 0.4 wt. % Mn, 0.02 to 0.2 wt. % Si, 0.05 to 0.30 wt. % Fe, 0.1 wt. % max. Cu, 0.1 wt. % max. Cr, 0.2 wt. % max. Zr, the remainder aluminum, incidental elements and impurities and providing a continuous caster such as a belt caster for continuously casting the molten aluminum alloy. The molten aluminum alloy is cast into a slab which is rolled into a sheet product and then annealed. The sheet has an improved distribution of intermetallic particles (Al—Fe—Mn) and improved formability. Thereafter, the sheet product is formed into a tube having a seam which is welded to provide a seam welded tube. The seam welded tube is placed in a forming die and hydroformed to form the frame member.

43 Claims, 7 Drawing Sheets

ALUMINUM AUTOMOTIVE FRAME MEMBERS

BACKGROUND OF THE INVENTION

This invention relates to aluminum alloy vehicular members and more particularly, it relates to a method of casting aluminum alloy into sheet having good forming characteristics and to forming the sheet into vehicular frame members.

In many instances, continuous casting of molten aluminum into slab utilizing twin belt or twin roll casters is favored over D.C. casting because the twin belt or twin roll casting can result in substantial energy savings and total conversion cost savings compared to the D.C. cast method. In the twin belt or twin roll process, molten metal is continuously introduced to an advancing mold and a slab is produced which may be continuously formed into a sheet product which is collected or wound into a coil. However, the continuous casting is not without problems. For example, it has been discovered that the alloy composition and the processing steps must be carefully controlled in order to have the formability level to avoid cracking during forming and yet have the requisite strength properties in the final product. That is, the alloy and the processing thereof must be carefully controlled to provide sheet having the formability suited to the fabricating steps necessary to form the final product or vehicular member. If the alloy and processing steps are not controlled, then in the forming steps, fracture can occur and the formed parts have to be scrapped. Thus, there is a great need for selection of an aluminum alloy, continuous casting thereof, and thermal mechanical processing methods which provide a sheet product having forming characteristics and strength properties which permit forming operations such as hydroforming for producing vehicular members while avoiding problems of fracturing or cracking, for example.

The continuous casting of molten aluminum and rolling slab produced therefrom into a sheet product is disclosed in various patents. For example, U.S. Pat. No. 5,976,279 discloses a process for continuously casting aluminum alloys and improved aluminum alloy compositions. The process includes the steps of continuously annealing the cold rolled strip in an intermediate anneal using an induction heater and/or continuously annealing the hot rolled strip in an induction heater. The alloy composition has mechanical properties that can be varied selectively by varying the time and temperature of a stabilizing anneal.

U.S. Pat. 6,264,765 discloses a method and apparatus for casting, hot rolling and annealing non-heat treatment aluminum alloys. The method and apparatus comprises continuous casting, hot rolling and in-line inductively heating the aluminum sheet to obtain the mechanical properties within the specification tolerance of the hot rolled product.

U.S. Pat. No. 5,985,058 discloses a process for continuously casting aluminum alloys and improved aluminum alloy compositions. The process includes the step of heating the cast strip before, during or after hot rolling to a temperature in excess of the output temperature of the cast strip from the chill blocks. The alloy composition has a relatively low magnesium content yet possesses superior strength properties.

U.S. Pat. No. 5,993,573 discloses a process for continuously casting aluminum alloys and improved aluminum alloy compositions. The process includes the steps of (a) heating the cast strip before, during or after hot rolling to a temperature in excess of the output temperature of the cast strip from the chill blocks and (b) stabilization or back annealing in an induction heater of cold rolled strip produced from the cast strip.

U.S. Pat. No. 5,833,775 discloses an aluminum alloy sheet and a method for producing an aluminum alloy sheet. The aluminum alloy sheet is useful for forming into drawn and ironed container bodies. The sheet preferably has an after-bake yield strength of at least about 37 ksi and an elongation of at least about 2 percent. Preferably the sheet also has earing of less than about 2 percent.

U.S. Pat. No. 6,086,690 discloses a process of producing an aluminum alloy sheet article of high yield strength and ductility suitable, in particular, for use in manufacturing automotive panels. The process comprises casting a non heat-treatable aluminum alloy to form a cast slab, and subjecting said cast slab to a series of rolling steps to produce a sheet article of final gauge, preferably followed by annealing to cause recrystallization. The rolling steps involve hot and warm rolling the slab to form an intermediate sheet article of intermediate gauge, cooling the intermediate sheet article, and then warm and cold rolling the cooled intermediate sheet to final gauge at a temperature in the range of ambient temperature to 340° C. to form said sheet article. The series of rolling steps is carried out continuously without intermediate coiling or full annealing of the intermediate sheet article. The invention also relates to the alloy sheet article produced by the process.

U.S. Pat. No. 5,244,516 discloses an aluminum alloy plate for discs superior in Ni—P platability and adhesionability of plated layer and having a high surface smoothness with a minimum of nodules and micropits, said aluminum alloy plate comprising an aluminum alloy containing as essential elements Mg in an amount more than 3% and equal to or less than 6%, Cu in an amount equal to or more than 0.03% and less than 0.3%, and Zn in an amount equal to or more than 0.03% and equal to or less than 0.4%, and as impurities Fe in an amount equal to or less than 0.07% and Si in an amount equal to or less than 0.06% in the case of semi-continuous casting, or Fe in an amount equal to or less than 0.1% and Si in an amount equal to or less than 0.1% in the case of strip casting, and also containing Al—Fe phase intermetallic compounds, with the maximum size being smaller than 10 $\mu$m and the number of particles larger than 5 $\mu$m being less than 5 per 0.2 $mm^2$, and Mg—Si phase intermetallic compounds, with the maximum size being smaller than 8 $\mu$m and the number of particles larger than 5 $\mu$m being less than 5 per 0.2 $mm^2$.

U.S. Pat. No. 5,514,228 discloses a method for manufacturing aluminum sheet stock which includes hot rolling an aluminum alloy sheet stock, annealing and solution heat treating it without substantial intermediate cooling and rapid quenching.

In spite of these disclosures, there is a great need for selection of aluminum alloy and method for producing vehicular parts or members utilizing a continuous caster, thermal mechanical processing, to provide good strength and levels of formability which forming into intricate parts without cracking.

The term "formability" when used herein is used to describe the ease with of metal can be shaped through plastic deformation. Formability of a metal ted by measuring strength, ductility, and the amount of deformation to cause failure.

The term "aluminum" when used herein is meant to include aluminum and its alloys.

The term "automotive" as used herein is meant to include automobile and other vehicular members such as truck frame members and other transport members having similar construction.

SUMMARY OF THE INVENTION

It is an object of the invention to provide an improved, low cost process including continuous casting and rolling to continuously produce aluminum sheet product having consistent levels of formability.

It is another object of the invention to provide a process including continuously casting a slab and rolling the slab into a sheet product suitable for use in producing vehicular parts.

It is still another object of the invention to provide a process employing continuous casting of molten aluminum into slab and rolling the slab into sheet product for forming tube products suitable for hydroforming into vehicular frame members.

And yet it is another object of the invention to provide an improved process for producing aluminum sheet product employing a continuous caster to produce slab, continuously rolling the slab to produce a sheet product and annealing the sheet product for forming into vehicular parts or members.

It is another object of the invention to provide a process for producing vehicular members such as frame members which includes continuously casting an aluminum alloy into a slab and rolling the slab to a sheet product having good levels of formability.

It is yet another object of the invention to provide a process for producing vehicular members such as frame members which includes continuously casting an aluminum alloy into a slab and rolling the slab to a sheet product having good levels of formability, forming the sheet product into a tube which is welded and hydroformed into a vehicular member.

And yet it is another object of the invention to provide a process for casting a molten alloy comprising 2.7 to 3.6 wt. % Mg, 0.1 to 0.4 wt. % Mn, 0.02 to 0.2 wt. % Si, 0.05 to 0.30 wt. % Fe, 0.1 wt. % max. Cu, 0.1 wt. % max. Cr, 0.2 wt. % max. Zr, the remainder aluminum, incidental elements and impurities, casting the alloy into a slab which is hot rolled and annealed to provide a sheet product which is hydroformed into a vehicular member such as a frame member.

In accordance with these objects, there is provided a process for producing aluminum vehicular members such as frame members from molten aluminum alloy using a continuous caster to cast the alloy into a slab. The method comprises providing a molten aluminum alloy consisting essentially of 2.7 to 3.6 wt. % Mg, 0.1 to 0.4 wt. % Mn, 0.02 to 0.2 wt. % Si, 0.05 to 0.3 wt. % Fe, 0.1 wt. % max. Cu, 0.1 wt. % max. Cr, 0.2 wt. % max. Zr, the remainder aluminum, incidental elements and impurities and providing a continuous caster such as a belt caster for continuously casting the molten aluminum alloy. The molten aluminum alloy is cast into a slab having Al—Fe—Mn-containing intermetallic particles. The slab is rolled into a sheet product which is then annealed to provide a sheet product having substantially uniform distribution or reduced striations of the intermetallic particles for improved formability and corrosion resistance. Thereafter, the sheet product is formed into a tube having a seam which is welded to provide a seam welded tube. The seam welded tube is placed in a forming die and hydroforned to form the frame member.

Alternatively, the hot rolled sheet may be cold rolled after hot rolling, and then annealed prior to the forming steps. In yet another embodiment, the hot rolled sheet may be annealed or even homogenized and then cold rolled to a cold rolled sheet product. The cold rolled product can be annealed to provide a product suited to the various forming steps.

These and other objects will become apparent from a reading of the specification and claims appended hereto.

Detailed Description of Preferred Embodiments

Figure 1:
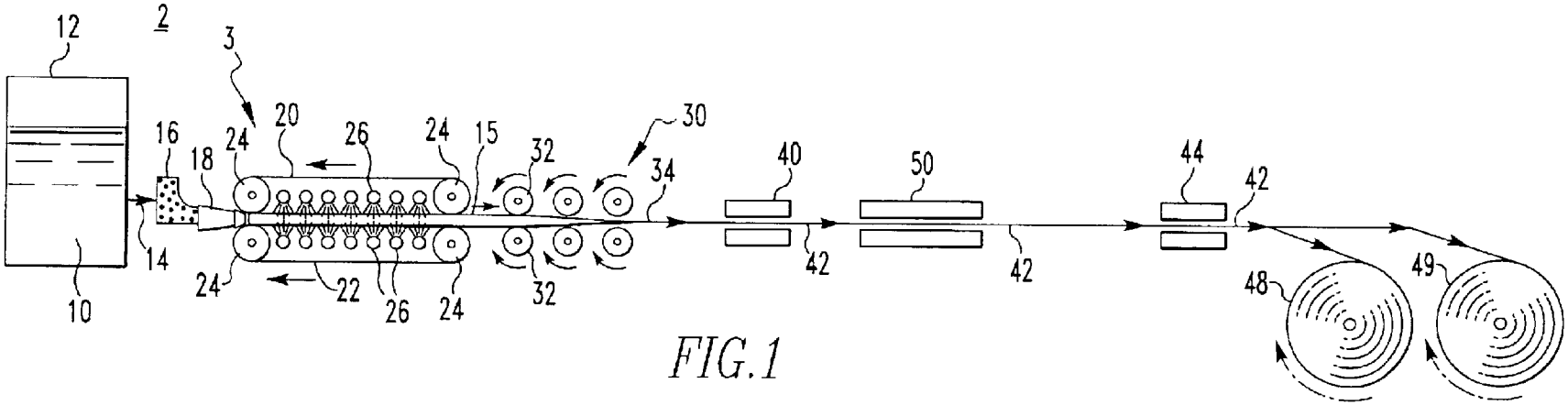
FIG. 1 is a schematic of a continuous caster, hot rolling mill and rolls of sheet material.

The vehicular frame members of the invention are comprised of an aluminum base alloy containing controlled amounts of magnesium, iron, silicon and manganese for the required strength and formability in the sheet product produced by the casting and thermomechanical process. The total amounts of the alloying elements are required to be controlled to meet the strength requirement without causing casting difficulty in the process. The amounts of alloying elements also are required to be controlled to provide the desired amounts or levels of intermetallic particles for improved formability, especially the amount of iron contents. The Al—Fe—Mn, Al—Mg—Si, intermetallic particles form during solidification. The distribution of such intermetallic particles after rolling of continuous cast aluminum slab can be severely striated or lined along the rolling direction, causing forming problems. By comparison, direct chill (D.C.) ingot cast material has a more uniform distribution of intermetallic particles providing good formability. Striations of intermetallic particles cause stress concentrations during plastic deformation which deteriorate formability of the sheet product. Thus, it is desired that the rolled sheet of the invention has a substantially uniform distribution of intermetallic particles to provide for improved formability.

Accordingly, the aluminum base alloy consists essentially of 2.7 to 3.6 wt. % Mg, 0.1 to 0.4 wt. % Mn, 0.02 to 0.2 wt. % Si, 0.05 to 0.3 wt. % Fe, 0.1 wt. % max. Cu, 0.1 wt. % max. Cr, 0.2 wt. % max. Zr, the remainder aluminum, incidental elements and impurities. Preferably, magnesium is maintained in the range of 2.8 to 3.3 wt. % and manganese is preferably maintained in the range of 0.15 to 0.35 wt. %. Further, preferably iron is maintained in the range of 0.10 to 0.25 wt. % and silicon is maintained in the range of 0.05 to 0.15 wt. %. Impurities are preferably limited to not more than 0.05 wt. % each and the combination of impurities should not be greater than 0.15 wt. % total.

Thus, it will be understood that to use an alloy of the above composition in the process of the invention to form automotive members having the requisite properties requires careful control of the alloying elements to avoid forming striations of intermetallic particles adverse to the forming operation. That is, it will be appreciated that in the present process, there is great difficulty in balancing all the constituents in the alloy and procedural steps necessary to forming a sheet product having desirable properties for forming into the final product while avoiding undesirable properties which leads to fracture or cracking, for example, during the forming process.

Not only is it important to have alloying elements and impurities in the controlled amounts as herein described, but the slab produced by continuous casting, the sheet formed from the slab must be prepared in accordance with specific method steps in order to produce sheet and automotive members or parts therefrom having the desirable characteristics. That is, the process must be controlled in order to produce product having near formability properties of D.C. ingot fabricated material without the cost penalties of the D.C. ingot process.

Thus, referring now to FIG. 1, there is shown a schematic illustration of a belt caster 2 and rolling mill for producing sheet suitable for forming into vehicular members in accordance with the invention.

In FIG. 1, molten aluminum 10 is provided in a furnace or reservoir 12. Molten aluminum from reservoir 12 is directed along line 14 to a tundish 16 from where it is metered through a nozzle 18 into an advancing mold created by revolving belts 20 and 22 and side dam blocks (not shown). Belts 20 and 22 are turned by means of rolls 24. Molten metal, e.g., molten aluminum, is solidified to form a continuous slab 15 between belts 20 and 22 which are chilled using coolant spray 26. Belt caster 2 is described in U.S. Pat. Nos. 3,864,973; 3,921,697; 4,648,438; 4,940,076 and 4,972,900, incorporated herein by reference as if specifically set forth. Improved nozzles for a belt caster are set forth in U.S. Pat. No. 5,452,827, incorporated herein by reference.

Another casting apparatus that may be used in the present invention is a block caster wherein the blocks are connected to form belts and is included herein as a belt caster. As described with respect to belt caster 2, a tundish and nozzle are provided to transfer molten metal to the block belts of the block caster wherein solidification occurs to provide a solidified slab 15 and the blocks are chilled to aid in solidification of the molten metal.

Yet another apparatus that may be utilized to cast a continuous strip or slab 15 is a roll caster which includes two rolls which rotate to provide the continuously advancing mold. As in the belt caster, a tundish and nozzle are used to transfer molten aluminum to the mold defined by the two rolls. Again, the rolls are normally chilled to aid in solidification of the molten metal into a strip or slab. The different casters are described in U.S. Pat. No. 5,452,827.

Molten aluminum alloy of the invention is introduced to the caster in a temperature range of about 1220° to 1320° F, typically 1250° to 1285° F, and exits the caster at a temperature in the range of 750° to 1050° F, typically 800° to 1050° F. In addition, typically the continuous slab exiting the caster has a thickness in the range of 0.1 to 2 inches, for example, 0.2 to 1.75 inch. A typical slab thickness for belt caster is about 0.5 to 1.0 inch. Belt casting speed can range from 10 to 40 ft/min, depending on the thickness of the slab. It is important to adhere to these casting conditions in order to obtain microstructures with less segregation for purposes of formability and corrosion resistance. It should be noted that D.C. cast material normally has good or substantially uniform distribution of Al—Fe—Mn particles. But, as noted earlier, D.C. cast material has the penalty of higher conversion costs than the subject continuous cast slab. Thus, the present invention provides continuous cast slab for forming into sheet material with near D.C. cast properties to obtain the cost savings and yet retain the desirable properties such as formability.

After exiting the caster, the slab 15 is directed to rolling mill 30 where it is rolled to form a rolled strip or flat product 34 using preferably a hot mill. Hot mill 30 is comprised of one or more pairs of oppositely opposed rolls 32 which reduces the thickness of the slab a controlled amount as it passes between each stand of rolls. Three sets of hot stands or rolls are illustrated in FIG. 1. For example, slab 15 having a thickness of about 0.2 to 1 inch would be reduced to a sheet product having a thickness of about 0.04 to 0.25 inch. Typically, for vehicular frame members the sheet product would have a thickness in the range of 0.08 to 0.2 inch, for example, 0.16 inch. The temperature of the slab entering hot mill 30 would typically be in the range of about 750° to 1000° F, if no heat is added. Typically, temperature of sheet product exiting mill 30 would be in the range of 350° to 700° F.

In another aspect of the invention, the slab from caster 3 may be heated prior to hot rolling (not shown in FIG. 1) to a temperature of 800° to 1100° F to increase the rolling temperature prior to hot rolling. Thus, slab entering the hot mill can have temperatures of about 800° to 1100° F.

Hot mill 30 can reduce the thickness of the slab about 60 to 95% of its original thickness, with typical reduction being 80 to 95%. Depending on the end use of the sheet product, heat may be applied to the strip or slab between hot stands in addition to or instead of heating prior to the hot mill.

The temperature of the aluminum alloy sheet exiting the hot mill can be in the range of about 400° to 825° F. if there was heat input before or during hot rolling.

After hot rolling, hot rolled strip 34 can have a deformation texture or deformed grain structure. The hot rolled strip can have a fully recrystallized grain structure with an optimum texture depending on previous heat input and rolling reduction. If the grain structure remains deformed and a recrystallized grain structure is necessary for the formation of the end product, then annealing of the hot rolled strip 34 can be applied to promote recrystallization of the deformed grain structures. For example, it is important for automotive application using the aluminum alloy of the invention to have a fine, fully recrystallized grain structure with random texture for the purpose of forming automotive parts in accordance with the invention. Thus, in the present invention, it is preferred that the hot rolled sheet be fully annealed to O-temper in annealer 40.

Referring to FIG. 1, it will be seen in the embodiment illustrated that the hot rolled sheet product is directed to a continuous annealer 40, using a heater such as an infrared, solenoidal or transverse flux induction heater. While any continuous heater may be used, an induction heater is preferred. Continuous anneal may also be required if cold rolling (not shown in FIG. 1) of the hot rolled strip is necessary. Thus, the hot or cold rolled strip may be continuously annealed in a temperature range of 600° to 1050° F. in time periods from 0.5 to 60 seconds in order to effect fully recrystallized sheet having fine grains and highly desired formability properties. However, care is required that the sheet product is not over annealed to the point where secondary recrystallization occurs. Secondary recrystallization is the growth of fine grains into undesirable coarse grains which are detrimental to formability.

Instead of continuous annealing, the hot rolled sheet may be batch annealed. That is, hot rolled sheet 42 is wound into coils 48 or 49. These coils are then placed in a furnace and soaked in a temperature range of 600° to 1000° F. for 2 to 10 hours to provide the rolled sheet in a fully annealed or O-temper condition. If the slab has been hot rolled to a gauge suitable for forming, then no further thermal mechanical processing is necessary and the sheet is in condition for the forming steps. If the slab has been hot rolled to an intermediate gauge, then after annealing, the annealed material is subjected to cold rolling followed by further annealing to provide sheet in the O-temper for forming operations.

After hot rolling, the hot rolled sheet or flat product may be allowed to cool prior to other operations. For example, after hot rolling, with or without annealing and cooling, the resulting strip 42 may be cold rolled (not shown in FIG. 1) to a sheet product having a final gauge. The cold rolling may be achieved by passing strip 42 through several pairs or stands comprising a cold mill to provide the cold rolling required to produce the final gauge. Cold rolling can reduce the thickness of strip 42 by 20% to 90%. Final gauge can range from 0.02 to 0.2 inch, typically 0.08 to 0.18 inch, for automotive frame members. It will be appreciated that the cold rolling can be performed in a cold rolling line separate from the subject continuous casting and rolling line.

After cold rolling to final gauge, the sheet product is subject to further anneal to ensure the required crystallographic texture and grain structure necessary for forming into the final automotive product.

Figure 3:
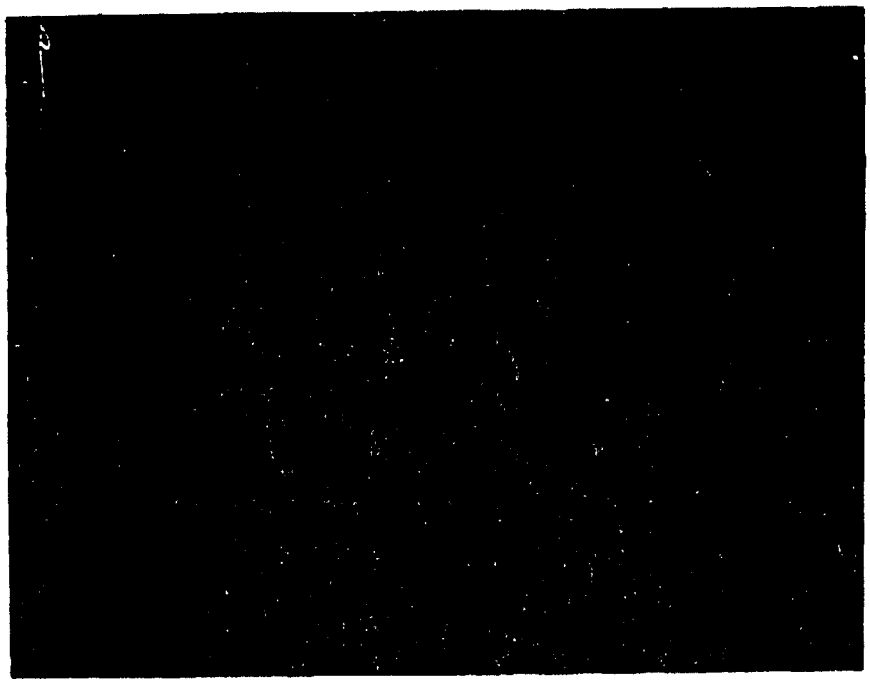
FIG. 3 is a micrograph at 200× showing the microstructure and particle distribution of D.C. cast AA5754.
Figure 4:
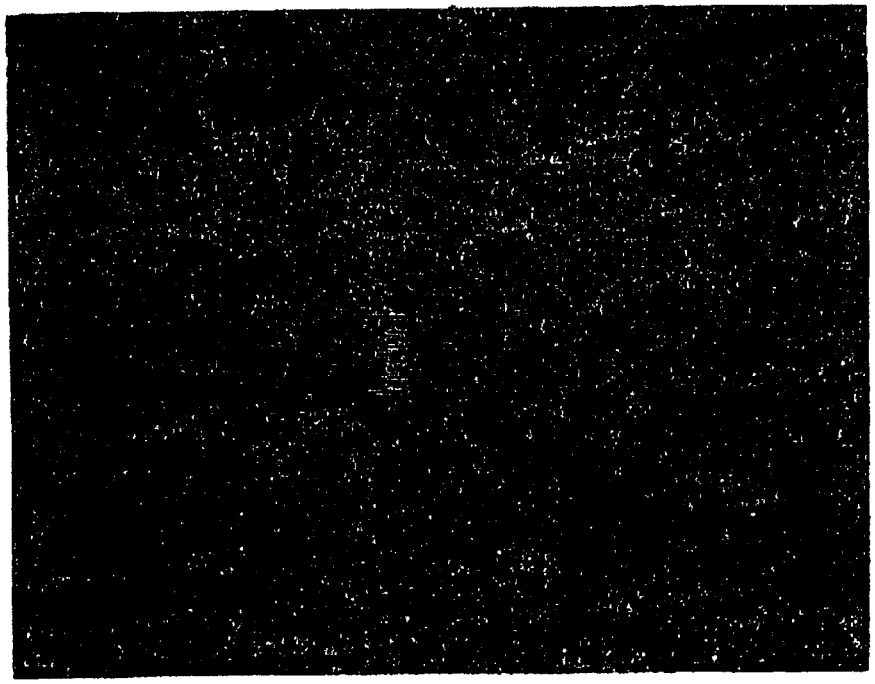
FIG. 4 is a micrograph at 200× of the microstructure and particle distribution of AA5754 alloy processed in accordance with the invention.

As an example of the desirable structures which have good forming characteristics, reference is made to FIGS. 3 and 4. FIG. 3 shows microstructure at 200× of D.C. (direct chill) cast ingot of AA5754 which was rolled to a thickness of 0.061 inch, annealed to O-temper or fully annealed condition. Inspection of the micrograph shows intennetallic particles comprised of Al—Fe—Mn, Al—Mg—Si particles (dark particles) having a generally oblong shape substantially uniformly dispersed with only minimal striations or lines of intermetallic particles which provides desirable formability. Particle size ranges from about 0.5 to 10 $\mu$m. The mean grain size is about 22.5 $\mu$m. FIG. 4 is a micrograph at 200× of continuously belt cast AA5754 which was hot rolled to 0.136 inch followed by cold rolling to a sheet product having a thickness of 0.061 inch. The cold rolled sheet product was then annealed at 730° F. for 4 hours to provide an O-temper condition. Inspection of the micrograph shows intermetallic precipitate comprised of Al—Fe—Mn, Al—Mg—Si particles substantially uniformly dispersed having less of an oblong shape when compared to D.C. cast material in FIG. 3 and having slightly more striations or lines of intermetallic particles. The size of the particles range from about 0.4 to 6 $\mu$m and the mean grain size is about 21.5 $\mu$m. Thus, it will be seen that the continuously belt cast microstructure is similar to D.C. cast microstructure and thus provides near formability properties of D.C. ingot fabricated material.

After hot rolling or annealing sheet 42 may be subject to a continuous rapid quenching such as cold water quench 50 prior to further operations. Quench 50, if used and shown after anneal, can be located at different locations in the process.

Annealed and hot rolled sheet product can have a tensile strength in the range of 28 to 35 KSI, a yield strength in the range of 13 to 17.5 KSI and an elongation greater than 19%, for example 19 to 25%.

Figure 2:
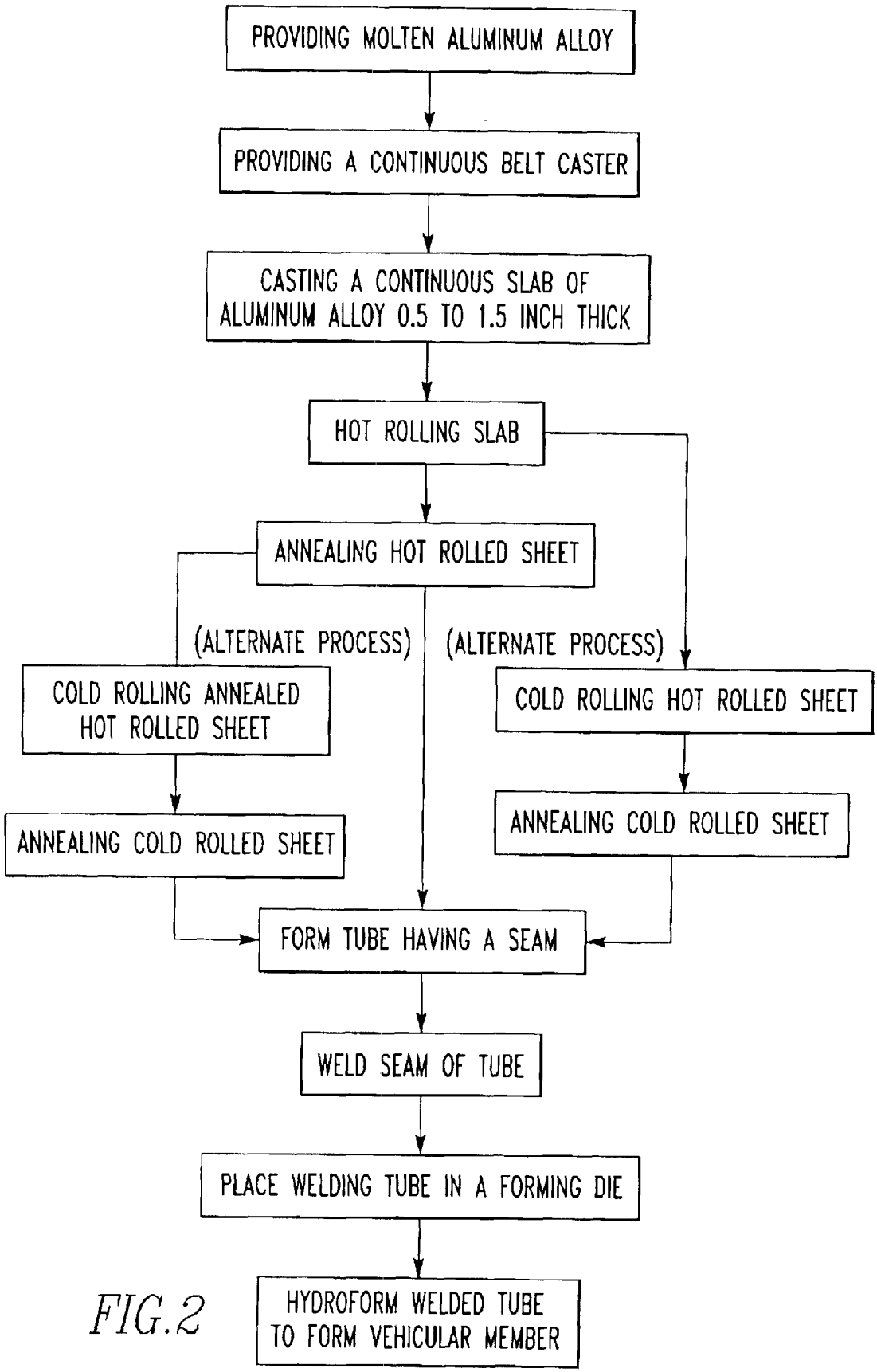
FIG. 2 is a flow chart showing steps in the invention.

Steps illustrative of the invention are set forth in FIG. 2. It will be seen in FIG. 2 that after annealing, rolled sheet may be formed directly into the shape of a tube having a seam. It will be understood that the annealed sheet may be first cut to the appropriate length prior to forming into seamed tube, depending on the application. Thereafter, the seam is welded to form a welded tube. Any form of welding may be employed that provides a suitable weld. This may include automated machine welders such as MIG or TIG welders.

Referring to FIG. 2, it will be seen that in an alternate process annealed hot rolled sheet may subject cold rolling followed by further annealing prior to being formed into a tube. In a further embodiment or alternate process, after hot rolling, the sheet may be directly cold rolled followed by annealing of the cold rolled sheet prior to being formed into a tube for welding.

After the tube is welded, it may be bent or formed to fit the die representative of the frame member. In many instances, the die cavity will have a boxshaped configuration. Thus, the tube member is bent to fit the tube cavity. In order to avoid weakness in the frame member, the design is selected in order that all transverse cross-sections of the profile of the frame member are smooth and continuous and do not include sharp corners which would give rise to stress concentrations and structural weaknesses. After the tube has been bent to provide a blank, the blank is placed in a die and the die closed.

Internal pressure is applied to the tube after the die is closed by introducing liquid such as water or oil to the inside of the tube. Both ends of the tube are closed off prior to introducing the liquid. Sufficient pressure is applied to the inside of the tube to expand it to fit the box-shaped cavity of the die to form the frame member having a continuous box-shaped cross section.

Figure 5:
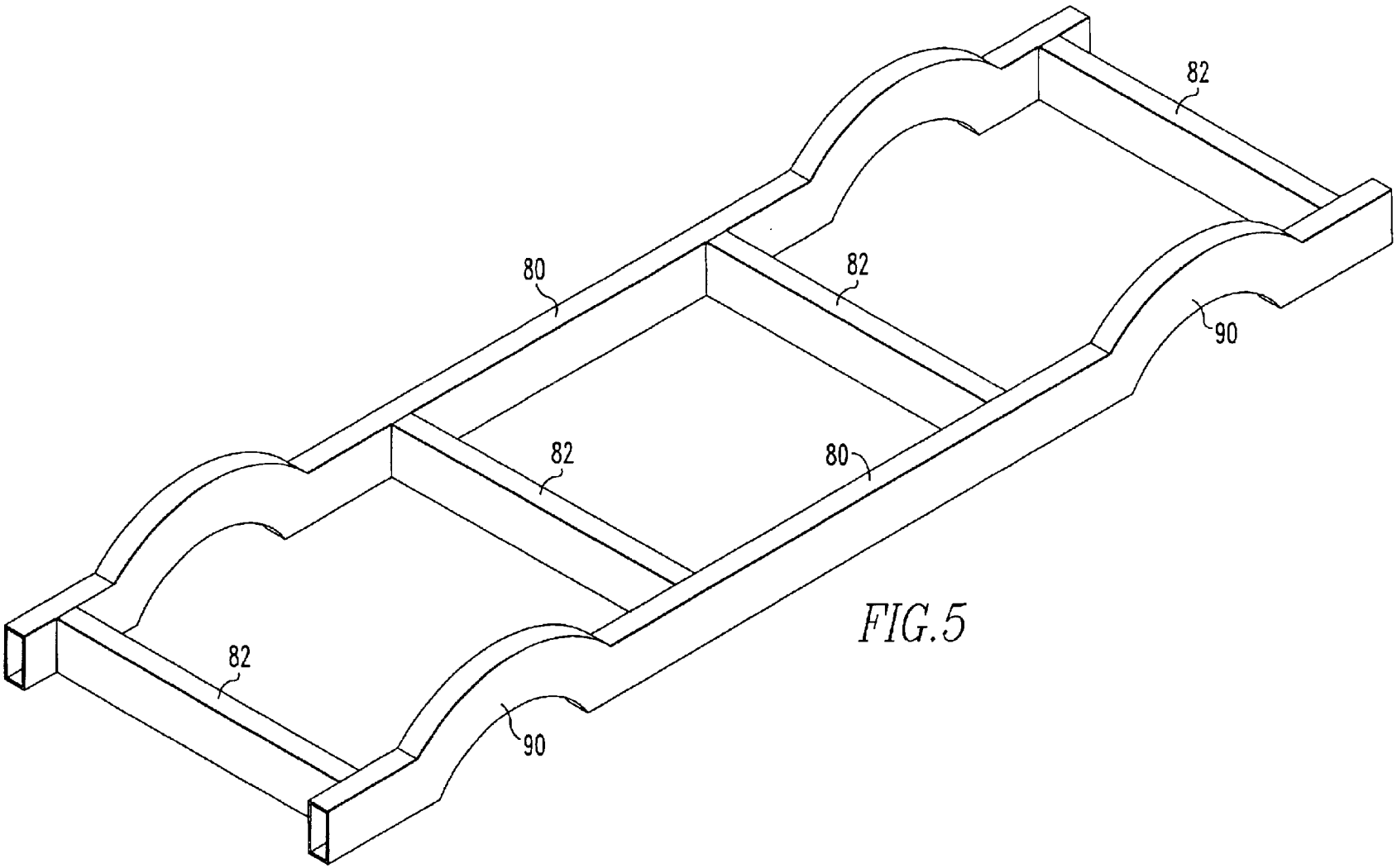
FIG. 5 is a schematic of a vehicular frame in accordance with the invention.
Figure 6:
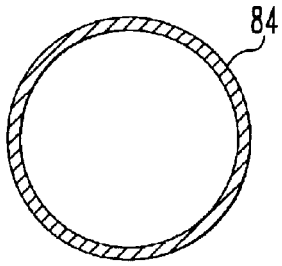
FIG. 6 is a schematic of a cross section of a tube of the invention.
Figure 7:
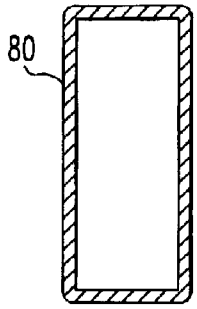
FIG. 7 is a cross-section of a formed frame rail.
Figure 8:
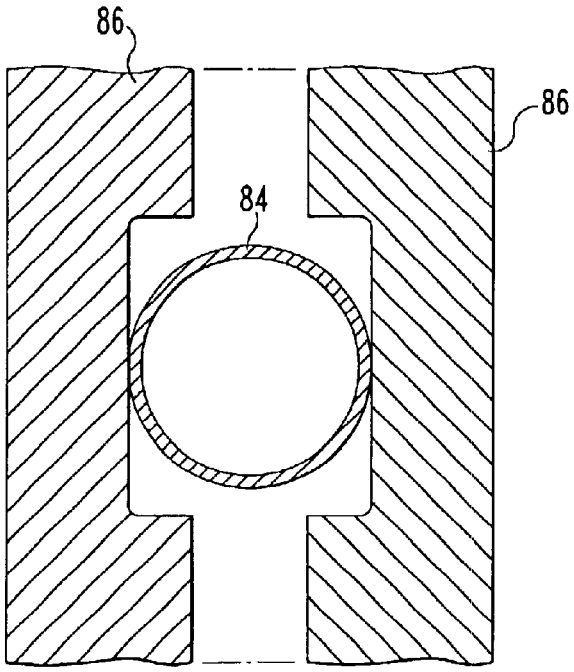
FIG. 8 is a cross-section illustrating a tube in forming dies.
Figure 9:
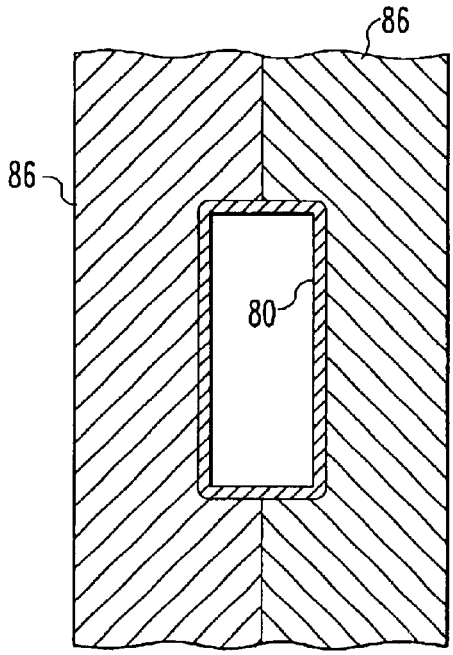
FIG. 9 is a cross-section illustrating a formed rail cross section after closing the dies and forming.

An automotive frame suitable for trucks is illustrated in FIG. 5. The embodiment shown in FIG. 5 is comprised of two longitudinal members 80 and four cross members 82. The longitudinal members 80 are generally box shaped in cross section, as shown in FIG. 7, for example. Cross members 82 can also be box shaped and are usually welded to members 80 to provide the vehicular frame. For purposes of forming members 80 and 82 from sheet material, as noted, the sheet is formed into a seamed tube and weld to provide a tube 84, as shown in cross section in FIG. 6. Tube 84 is then placed between dies 86 as shown in FIG. 8, having the desired configuration including axle arches 90 (FIG. 5), for example. Prior to placing tube 84 between dies 82, it is usually pre-bent to the general configuration so as to be accommodated by the dies. The dies are then closed as shown in FIG. 9 and sufficient pressure applied to force tube 84 to conform to the box configuration shown in FIG. 7. Methods of hydroforming are disclosed in U.S. Pat. Nos. 4,829,803; 4,567,743 and 6,257,035, incorporated herein by reference.

Figure 10:
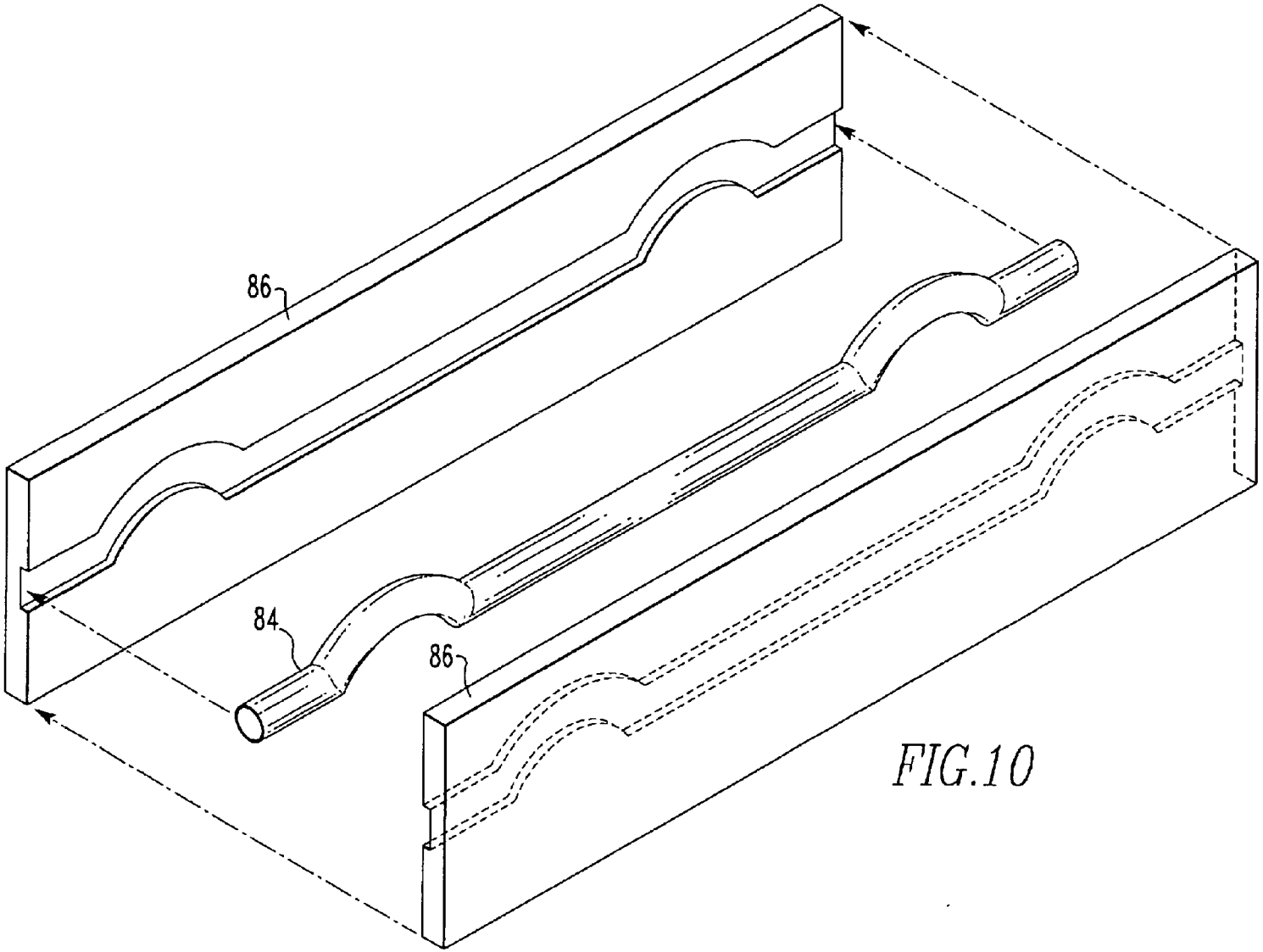
FIG. 10 is a perspective view illustrating pre-bent tube in hydroforming dies.
Figure 11:
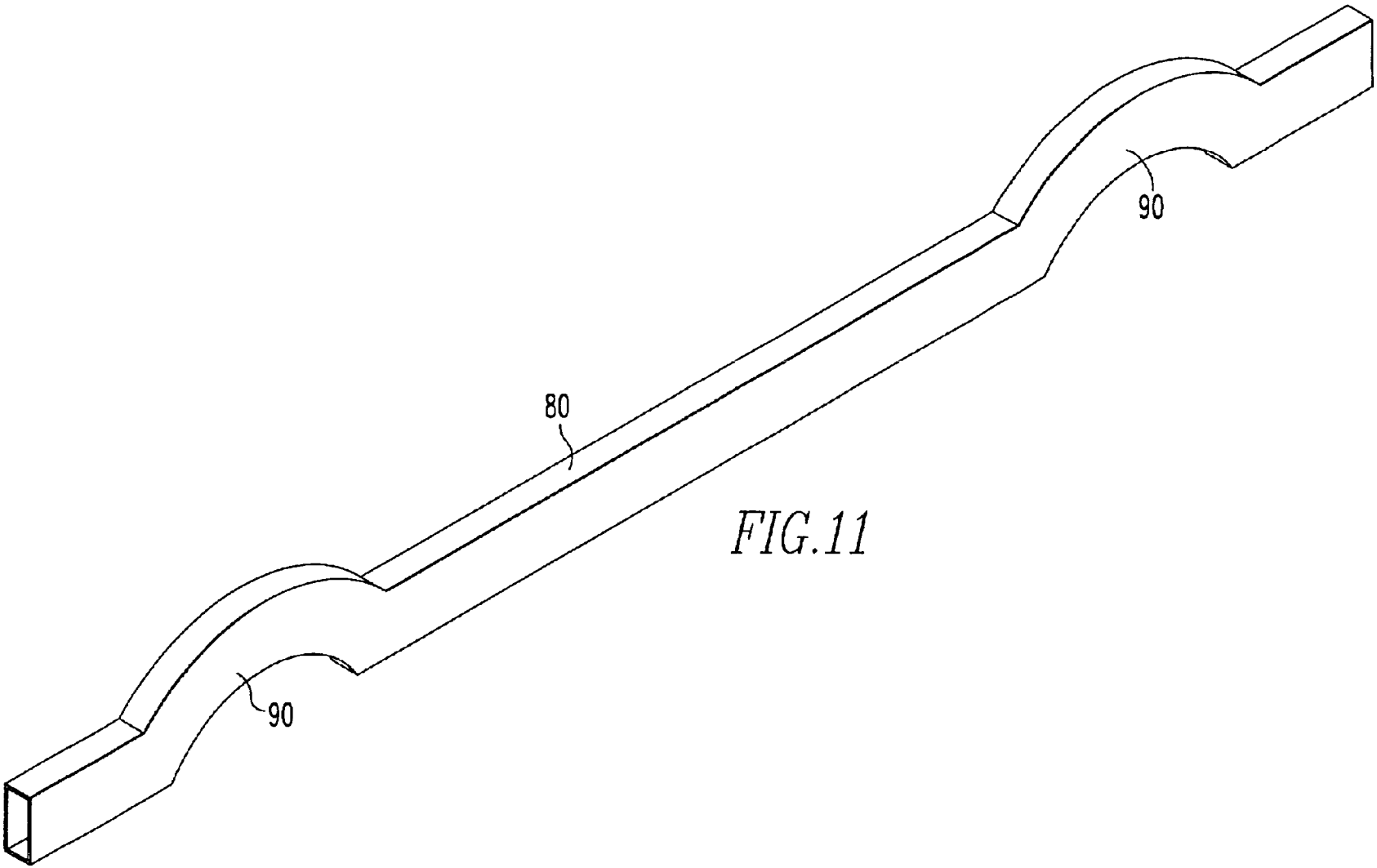
FIG. 11 is a schematic of a vehicular frame rail after forming.

Dies 86 for forming longitudinal frame member 80 are illustrated in FIG. 10 where pre-bent tube 84 is positioned in the dies. FIG. 10 shows tube 84 just prior to the dies being closed. FIG. 11 is an illustration of resulting frame rail 80 after the dies have been closed and tube 84 hydroformed to fill the cavities in the dies.

It will be appreciated that the method of the invention can be applied using different alloys, particularly different AA5XXX series alloys and can be used to form automotive parts other than vehicular frame members.

The following example is further illustrative of the invention.

EXAMPLE 1

An aluminum base alloy containing 2.86 wt. % Mg, 0.32 wt. % Mn, 0.10 wt. % Si, 0.24 wt. % Fe, 0.03 wt. % Cu and 0.01 wt. % Cr, was fed to a twin belt caster at a temperature of 1260° F. and solidified to produce a 0.60 inch thick slab exiting the caster at a temperature of 900° F. The slab was hot rolled to final gauge of 0.160 inch in a two stand hot rolling mill by introducing the slab to the hot mill at a temperature of about 820° F. and exiting the mill at 550° F. The hot rolled sheet was wound into a coil. The coil was annealed at a temperature of 800° F. for 4 hours. The annealed material had tensile strength of 30.4 ksi, yield strength of 13.2 ksi, and elongation of 23%. The annealed sheet was formed into a tube, seam welded and then hydroformed into a frame member. Thus, it will be seen that the alloy can be cast in a belt caster, rolled into a sheet product, shaped into a tube, seam welded and hydroformed into frame member having the required properties.

Thus, the continuous caster can be used to produce a slab which can be thermomechanically treated to form a sheet product that is fabricated into tubes and then hydroformed into vehicular frame members.

Having described the presently preferred embodiments, it is to be understood that the invention may be otherwise embodied within the scope of the appended claims.

What is claimed is:

1. In the production of an aluminum automotive frame member from a molten aluminum alloy using a continuous caster to cast the alloy into a slab, the method comprising:

(a) providing a molten aluminum alloy consisting essentially of 2.7 to 3.6 wt. % Mg, 0.1 to 0.4 wt. % Mn, 0.02 to 0.2 wt. % Si, 0.05 to 0.30 wt. % Fe, 0.1 wt. % max. Cu, 0.1 wt. % max. Cr, 0.2 wt. % max. Zr, the remainder aluminum, incidental elements and impurities;

(b) providing a continuous caster for continuously casting said molten aluminum alloy;

(c) casting said molten aluminum alloy into a slab having Al—Fe—Mn intermetallic particles;

(d) rolling said slab into a sheet product;

(e) annealing said sheet product to an O-temper condition, said sheet product having a substantial uniform distribution of said intermetallic particles;

(f) forming said sheet in said O-temper condition into a tube having a seam;

(g) welding said seam to provide a seam welded tube;

(h) placing said seam welded tube in a forming die; and (i) hydroforming said seam welded tube to form said automotive frame member.

2. In the production of an aluminum frame member in accordance with claim 1 wherein manganese is maintained in the range of 0.1 to 0.35 wt. %.

3. In the production of an aluminum frame member in accordance with claim 1 wherein magnesium is maintained in the range of 2.8 to 3.3 wt. %.

4. In the production of an aluminum frame member in accordance with claim 1 wherein iron is maintained in the range of 0.1 to 0.25 wt. %.

5. In the production of an aluminum frame member in accordance with claim 1 wherein said continuous caster is a belt caster.

6. In the production of an aluminum frame member in accordance with claim 1 including annealing said sheet product in a temperature range of 650° to 950° F.

7. In the production of an aluminum frame member in accordance with claim 1 including annealing said sheet product in a temperature range of 700° to 900° F.

8. In the production of an aluminum frame member in accordance with claim 7 including annealing for about 2 to 10 hours.

9. In the production of an aluminum frame member in accordance with claim 1 including continuously annealing said sheet product.

10. In the production of an aluminum frame member in accordance with claim 1 including hot rolling said slab to a hot rolled sheet product.

11. In the production of an aluminum frame member in accordance with claim 1 including hot rolling said slab to a hot rolled sheet product followed by cold rolling to a cold roll sheet product.

12. In the production of an aluminum frame member in accordance with claim 11 wherein said cold rolling provides a 20 to 90% gauge reduction.

13. In the production of an aluminum frame member in accordance with claim 11 wherein said cold rolled sheet product is annealed in a temperature range of 600° to 950° F.

14. In the production of an aluminum automotive frame member from molten aluminum alloy using a continuous caster to cast the alloy into a slab, the method comprising:

(a)providing a molten aluminum alloy consisting essentially of 2.7 to 3.6 wt. % Mg, 0.1 to 0.25 wt. % Mn, 0.02 to 0.2 wt. % Si, 0.05 to 0.25 wt. % Fe, 0.1 wt. % max. Cu, 0.1 wt. % max. Cr, 0.2 wt. % max. Zr, the remainder aluminum, incidental elements and impurities;

(b) providing a belt caster for continuously casting said molten aluminum alloy;

(c) casting said molten aluminum alloy into a slab having a thickness in the range of 0.4 inch to 1.75 inch and having intermetallic particles;

(d) hot rolling said slab into a hot rolled sheet product, said hot rolling starting in a temperature range of 750° to 1000° F. and ending in a temperature of 350° to 700° F.;

(e) annealing said hot rolled sheet product, said hot rolled sheet product after annealing having a tensile strength in the range of 28 to 35 KSI, a yield strength in the range of 13 to 17.5 KSI, and an elongation greater than 19% having a substantially uniform distribution of said intermetallic particles;

(f) forming said sheet product after annealing into a tube having, a seam;

(g) welding said seam to provide a seam welded tube;

(h) placing said seam welded tube in a forming die; and (i) hydroforming said seam welded tube to form said vehicular member.

15. The method in accordance with claim 14 wherein magnesium is maintained in the range of 2.8 to 3.3 wt. %.

16. The method in accordance with claim 14 wherein iron is maintained in the range of 0.05 to 0.2 wt. %.

17. The method in accordance with claim 14 including annealing said hot rolled sheet in a temperature range of 650° to 950° F.

18. The method in accordance with claim 17 including annealing for about 2 to 10 hours.

19. The method in accordance with claim 14 including annealing said hot rolled sheet in a temperature range of 700° to 900° F.

20. The method in accordance with claim 14 including continuously annealing said sheet product.

21. The method in accordance with claim 14 including cold rolling said hot rolled sheet product.

22. The method in accordance with claim 21 wherein said cold rolling provides a 20 to 90% gauge reduction.

23. The method in accordance with claim 21 including annealing said hot rolled sheet product.

24. A method for producing aluminum vehicular frame member from molten aluminum alloy using a continuous caster to cast the alloy into a slab, the method comprising:

(a) providing a molten aluminum alloy consisting essentially of 2.8 to 3.6 wt. % Mg, 0.1 to 0.25 wt. % Mn, 0.02 to 0.2 wt. % Si, 0.05 to 0.25 wt. % Fe, 0.1 wt. % max. Cu, 0.1 wt. % max. Cr, 0.2 wt. % max. Zr, the remainder aluminum, incidental elements and impurities;

(b) providing a belt caster for continuously casting said molten aluminum alloy;

(c) casting said molten aluminum alloy into a slab;

(d) hot rolling said slab into a hot rolled sheet product;

(e) cold rolling said hot rolled sheet product to a thickness in the range of 0.12 inch to 0.2 inch to provide a cold rolled sheet product;

(f) annealing said cold rolled sheet product to provide an annealed sheet product, said annealed sheet product having a tensile strength in the range of 28 to 35 KSI, a yield strength in the range of 13 to 17.5 KSI and an elongation greater than 19%;

(g) forming said annealed sheet product into a tube having a seam;

(h) welding said seam to provide a seam welded tube;

(i) placing said seam welded tube in a forming die; and (j) hydroforming said seam welded tube to form said vehicular frame member.

25. The method in accordance with claim 24 including annealing said cold rolled product to an O-temper condition.

26. The method in accordance with claim 24 including annealing said hot rolled sheet product prior to cold rolling.

27. The method in accordance with claim 26 including annealing in a temperature range of 650° to 950° F.

28. The method in accordance with claim 27 including annealing for about 2 to 10 hours.

29. The method in accordance with claim 26 including annealing in a temperature range of 700° to 900° F.

30. The method in accordance with claim 26 including continuously annealing said sheet product.

31. The method in accordance with claim 24 wherein said cold rolling provides a 25 to 60% gauge reduction.

32. A method for producing aluminum vehicular member from molten aluminum alloy using a belt caster to cast the alloy into a slab, the method comprising:

(a) providing a molten aluminum alloy consisting essentially of 2.8 to 3.6 wt. % Mg, 0.1 to 0.3 wt. % Mn, 0.02 to 0.2 wt. % Si, 0.05 to 0.3 wt. % Fe, 0.1 wt. % max. Cu, 0.1 wt. % max. Cr, 0.2 wt. % max. Zr, the remainder aluminum, incidental elements and impurities;

(b) providing a belt caster for continuously casting said molten aluminum alloy;

(c) casting said molten aluminum alloy into a slab;

(d) hot rolling said slab into a hot rolled sheet product, said hot rolling starting in a temperature range of 750° F. to 1000° F. and ending in a temperature range of 350° to 825° F.;

(e) annealing said hot rolled sheet product to provide an annealed sheet product;

(f) cold rolling said annealed sheet product to a thickness in the range of 0.08 inch to 0.2 inch to provide a cold rolled sheet product having a tensile strength in the range of 28 to 35 KSI, a yield strength in the range of 13 to 17.5 KSI and an elongation of greater than 19%;

(g) forming said cold rolled sheet product into a tube having a seam;

(h) welding said seam to provide a seam welded tube;

(i) placing said seam welded tube in a forming die; and (j)hydroforming said seam welded tube to form said vehicular member.

33. The method in accordance with claim 32 including batch annealing said hot rolled product.

34. The method in accordance with claim 32 including continuous annealing said hot rolled sheet product.

35. The method in accordance with claim 32 including annealing in a temperature range of 650° to 950° F.

36. The method in accordance with claim 32 including annealing in a temperature range of 700° to 900° F.

37. The method in accordance with claim 32 wherein said cold rolling provides a 20 to 90% gauge reduction.

38. The method in accordance with claim 32 wherein manganese is maintained in the range of 0.1 to 0.25 wt. %.

39. The method in accordance with claim 32 wherein magnesium is maintained in the range of 2.8 to 3.3 wt. %.

40. The method in accordance with claim 32 wherein iron is maintained in the range of 0.05 to 0.25 wt. %.

41. The method in accordance with claim 32 wherein said cold rolled sheet product has a thickness in the range of 0.1 inch to 0.18 inch.

42. A method for producing aluminum vehicular member from molten aluminum alloy using a belt caster to cast the alloy into a slab, the method comprising:

(a) providing a molten aluminum alloy consisting essentially of 2.8 to 3.6 wt. %.Mg, 0.1 to 0.3 wt. % Mn, 0.02 to 0.2 wt. % Si, 0.05 to 0.25 wt. % Fe, 0.1 wt. % max. Cu, 0.1 wt. % max. Cr, 0.2 wt. % max. Zr, the remainder aluminum, incidental elements and impurities;

(b) providing a belt caster for continuously casting said molten aluminum alloy;

(c) casting said molten aluminum alloy into a slab;

(d) hot rolling said slab into a hot rolled sheet product, said hot rolling starting in a temperature range of 700° F. to 1000° F. and ending in a temperature range of 350° to 700° F.;

(e) annealing said hot rolled sheet product to provide an annealed sheet product;

(f) cold rolling said annealed sheet product to a thickness in the range of 0.12 inch to 0.2 inch;

(g) annealing said cold rolled sheet product to provide a cold rolled and annealed sheet product having a tensile strength in the range of 28 to 35 KSI, a yield strength in the range of 13 to 17.5 KSI and an elongation of greater than 19%;

(h) forming said cold rolled and annealed sheet product into a tube having a seam;

(i) welding said seam to provide a seam welded tube;

(j) placing said seam welded tube in a forming die; and (k) hydroforming said seam welded tube to form said vehicular member.

43. A method for producing aluminum vehicular frame member from molten aluminum alloy using a belt caster to cast the alloy into a slab, the method comprising:

(a) providing a molten aluminum alloy consisting essentially of 2.8 to 3.6 wt. % Mg, 0.1 to 0.3 wt. % Mn, 0.02 to 0.2 wt. % Si, 0.05 to 0.25 wt. % Fe, 0.1 wt. % max. Cu, 0.1 wt. % max. Cr, 0.2 wt. % max. Zr, the remainder aluminum, incidental elements and impurities;

(b) providing a belt caster for continuously casting said molten aluminum alloy into a slab having a thickness in the range of 0.4 inch to 1.75 inch;

(c) hot rolling said slab into a hot rolled sheet product starting in a temperature range of 700° to 1000° F. and ending in a temperature range of 350° to 700° F.;

(d) annealing said hot rolled sheet product in a temperature range of 700° to 900° F. to provide an annealed product;

(e) cold rolling said annealed product to a cold rolled sheet product having a thickness in the range of 0.1 inch to 0.2 inch;

(f) annealing said cold rolled sheet product to provide a cold rolled and annealed sheet product having a tensile strength in the range of 28 to 35 KSI, a yield strength in the range of 13 to 17.5 KSI and an elongation in the range of 17 to 25%;

(g) forming said cold rolled and annealed sheet into a tube having seam;

(h) welding said seam to provide a seam welded tube;

(i) placing said seam welded tube in a forming die; and (j) hydroforming said seam welded tube to form said vehicular frame member.

* * * * *